US011613884B2

(12) United States Patent
Wang

(10) Patent No.: US 11,613,884 B2
(45) Date of Patent: Mar. 28, 2023

(54) COMBINATION TOILET UNBLOCKING AND CLEANING TOOL

(71) Applicant: Chi Fu Wang, Jersey City, NJ (US)

(72) Inventor: Chi Fu Wang, Jersey City, NJ (US)

( * ) Notice: Subject to any disclaimer, the term of this patent is extended or adjusted under 35 U.S.C. 154(b) by 663 days.

(21) Appl. No.: 16/746,840

(22) Filed: Jan. 18, 2020

(65) Prior Publication Data

US 2021/0222419 A1 Jul. 22, 2021

(51) Int. Cl.

| | |
|---|---|
| ***E03F 9/00*** | (2006.01) |
| ***A47K 11/10*** | (2006.01) |
| ***A47L 13/46*** | (2006.01) |
| ***B08B 9/027*** | (2006.01) |
| ***A47L 13/02*** | (2006.01) |

(52) U.S. Cl.

CPC ..... *E03F 9/005* (2013.01); *A47K 11/10* (2013.01); *A47L 13/02* (2013.01); *A47L 13/46* (2013.01); *B08B 9/027* (2013.01)

(58) Field of Classification Search

CPC ..... E03F 9/005; A47K 11/10; A47L 13/02; A47L 13/46; B08B 9/027; E03D 9/00; E03D 11/00

See application file for complete search history.

(56) References Cited

U.S. PATENT DOCUMENTS

| | | | | |
|---|---|---|---|---|
| 6,804,839 | B1 * | 10/2004 | McMaster | A47K 11/10 4/255.11 |
| 7,299,519 | B1 * | 11/2007 | Garry | A46B 15/00 15/160 |
| 7,308,728 | B2 * | 12/2007 | Haviv | A47K 11/10 15/160 |
| 7,430,779 | B1 * | 10/2008 | Garry | A47K 11/10 15/105 |
| 7,752,684 | B1 * | 7/2010 | Pieretti | E03C 1/308 15/105 |
| 8,209,790 | B1 * | 7/2012 | Garry | A46B 15/00 4/255.11 |
| 8,458,845 | B1 * | 6/2013 | Tabieros | A46B 5/0095 15/104.31 |
| 2004/0025235 | A1 * | 2/2004 | Tash | E03C 1/302 4/255.01 |
| 2006/0260077 | A1 * | 11/2006 | Wilson | A46B 5/0033 15/104.16 |
| 2014/0026307 | A1 * | 1/2014 | Washington, Jr. | E03F 9/005 4/255.01 |
| 2017/0251891 | A1 * | 9/2017 | Libman | B25G 1/102 |

* cited by examiner

*Primary Examiner* — Randall E Chin
(74) *Attorney, Agent, or Firm* — Wang Law Firm, Inc.

(57) ABSTRACT

A combination toilet unblocking/cleaning apparatus for providing both a toilet unblocking and toilet cleaning tool in one convenient unit. The toilet unblocking tool further includes an adjustable auger, a combined tongs, and a detachable rod. Wherein, the adjustable auger includes two drain cleaning cable connected to a slider and slidable held in an elongated sleeve member; and the detachable rod is removably attached to the adjustable auger to form a combined tongs, constructed in such manner that the rod member can be used individually as drain rod. Also, the combination toilet cleaning tool is using the combined tongs as a handle with a plurality of different detachable bathroom accessories. Accessories may include a brush, a plunger, and a scraper; in which the brush, the plunger, and the scraper are configured to be selectively and removably coupled to the combined tongs.

12 Claims, 9 Drawing Sheets

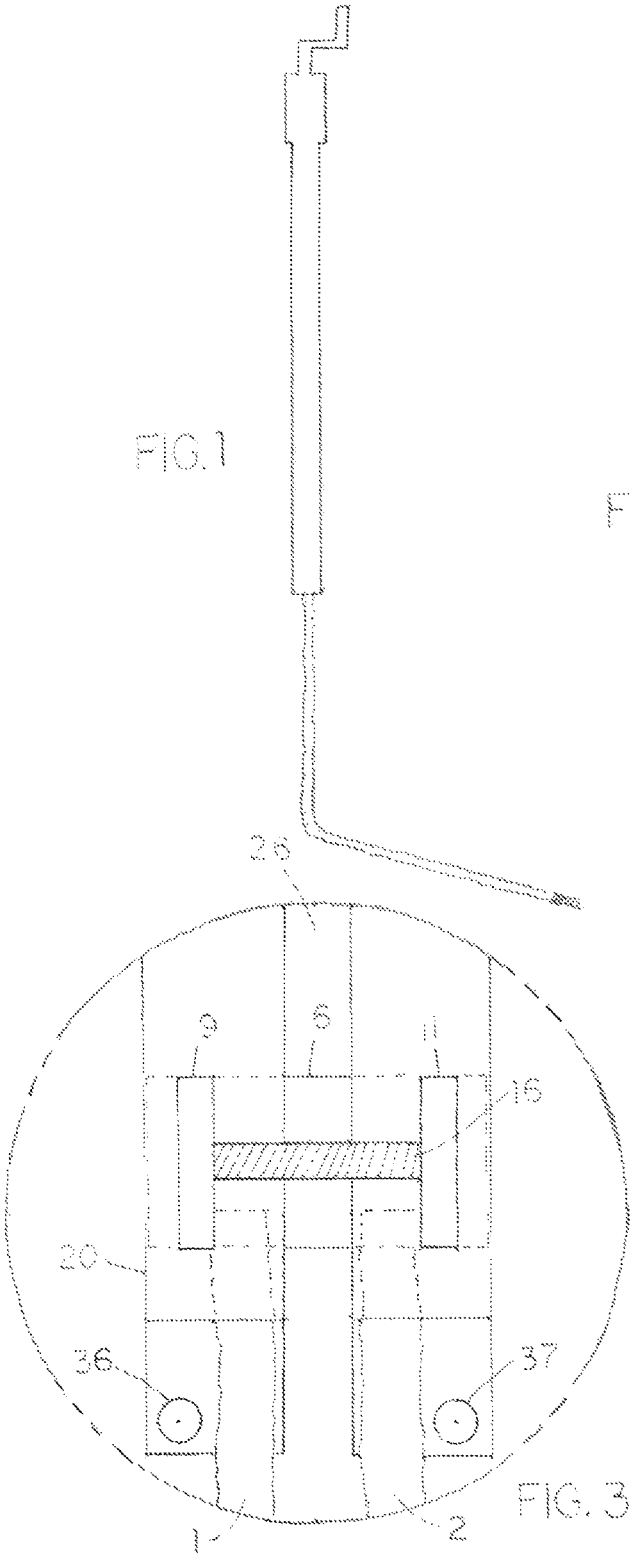
FIG. 1
FIG. 3
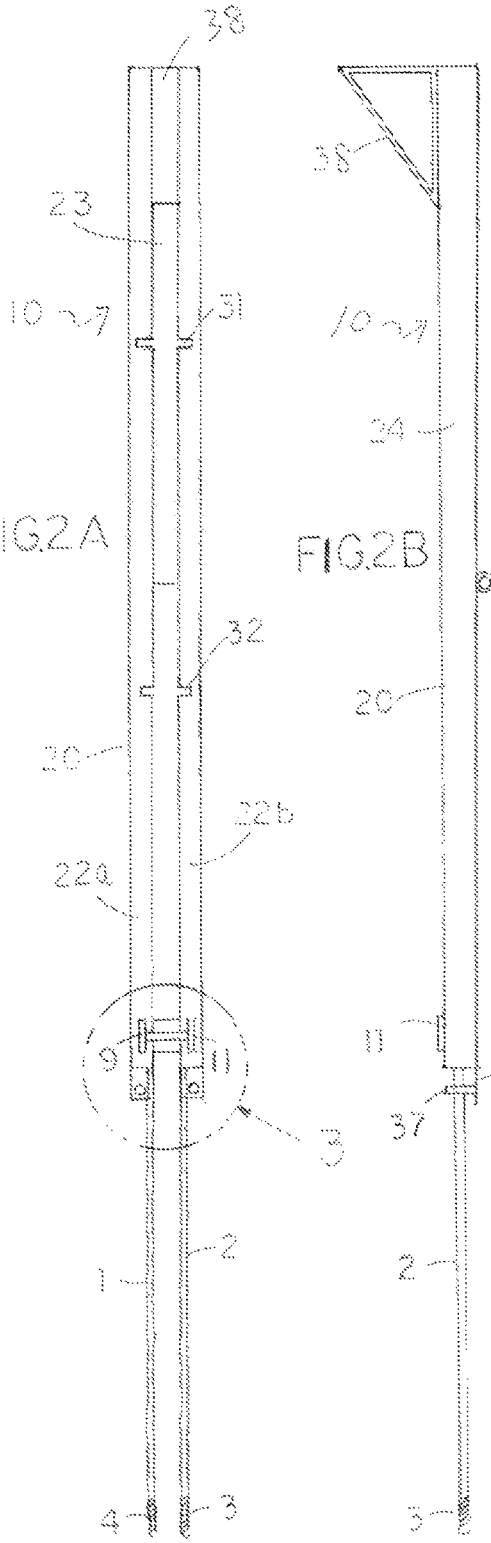
FIG. 2A
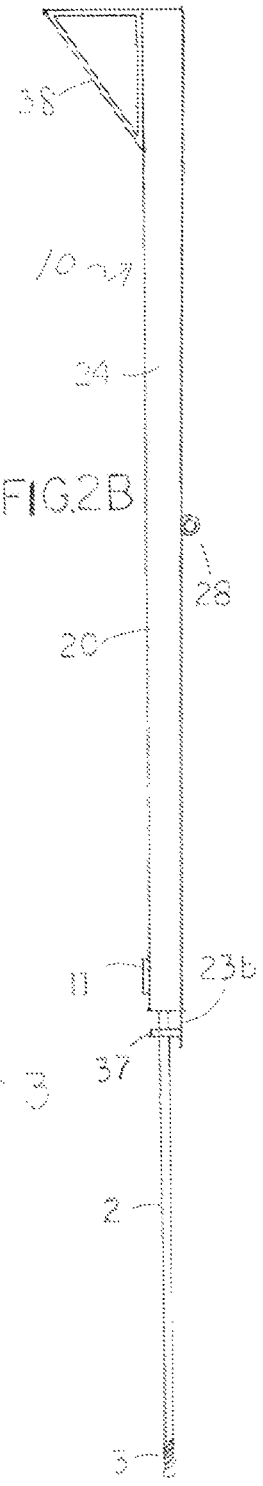
FIG. 2B

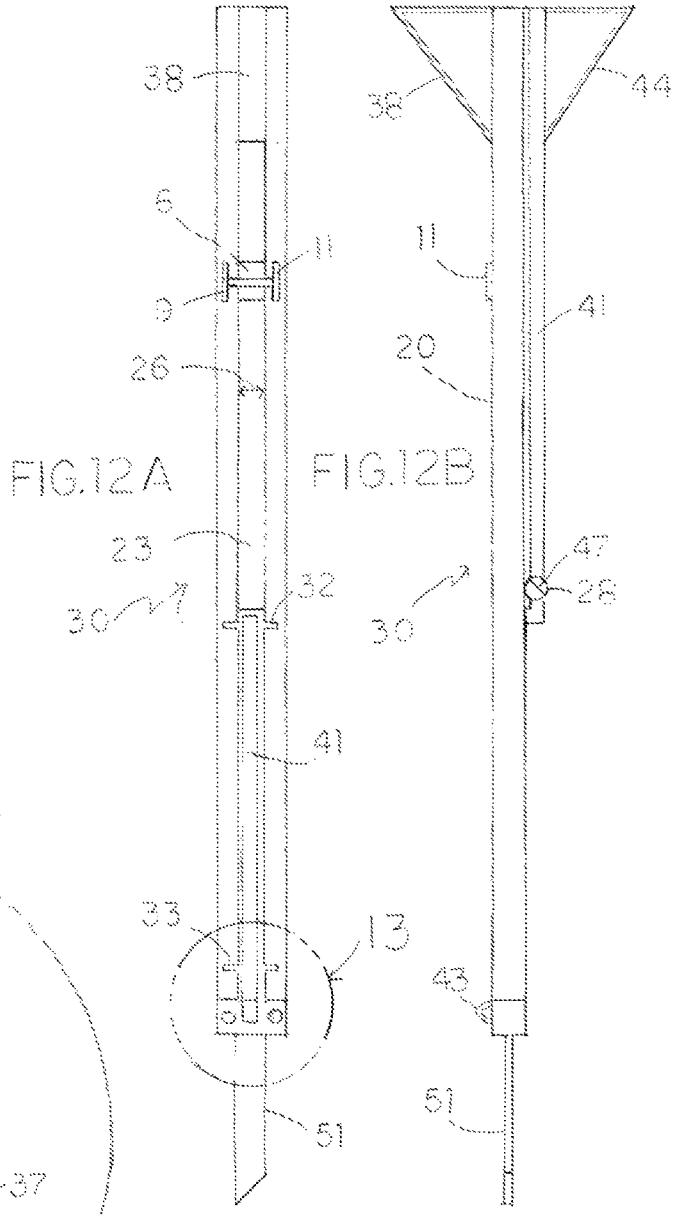
FIG.12A
FIG.12B
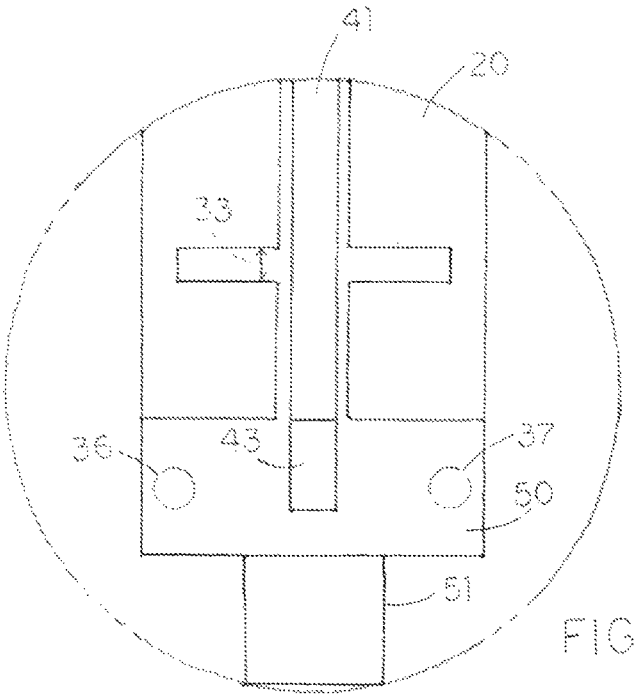
FIG.13

COMBINATION TOILET UNBLOCKING AND CLEANING TOOL

FIELD OF THE INVENTION

The present invention relates to the combination of toilet unblocking/cleaning tools into one convenient unit, featuring an adjustable auger and detachable rod. The detachable rod, which can be used individually as a drain rod, will be attached to the adjustable auger to form tongs. Add-ons in the form of a brush, plunger, or scraper will be available and will be able to be attached and detached.

BACKGROUND OF THE INVENTION

A wide variety of tools have been developed for use in unclogging toilets or cleaning toilets. These tools include toilet auger, toilet plunger, and toilet brush, etc., which have been used for many years. Their general structure, methods of manufacture, function and usefulness are well known. However, these tools still have some deficiencies related to their structure, which can be improved. The list below are these tools with improvements provided by the present invention.

A conventional toilet auger generally comprises an elongated drain cleaning cable having an outer lead end and an inner end coiled within a crank device (refer to FIG. 1). Generally, the user positions the lead end of the drain cleaning cable just inside the outlet duct of the toilet and uses the crank device to push the lead end of the drain cleaning cable past the trap and over the hump. Then the crank is turned until the clog is removed from the drain.

However, a crank device and the elongated drain cleaning cable requires a large storage space. Additionally, conventional toilet auger has no cover for the elongated drain cleaning cable. Because the cable is exposed, the product is unsanitary even when washed after cleaning the drain. In order to reduce the size of the conventional toilet auger and keep the product sanitary, the present invention attaches the auger to other tools and keeps a cover on the auger.

A conventional toilet plunger consists of a deformable suction cup attached to a rigid handle and utilizes alternating suction and pressure to dislodge obstructions in the outlet duct of the toilet. In use, the user is required to push the suction cup into the toilet and then move the handle up and down in an effort to create sufficient suction and pressure to clear the blockage.

However, most plunger handles are too short, causing a user to bend his/her waist, excluding it from use from some less able-bodied people (the elderly in particular). Moreover, use of the short plunger often causes water or waste to splash outside of the toilet bowl onto the user. The present invention showcases a detachable plunger with a longer handle, to provide ease to a larger demographic.

A conventional toilet brush include a myriad of flexible bristles extending form a center rod or a bristle surface. The rod or surface is generally coupled to a handle for easy manipulation.

The same problems that plague the plunger also affect the toilet brush. By design, brushes are often singular instruments on shorter handles. By introducing a detachable plunger/brush that can be swap on in place of the original design saves the user on cost and space, as well as offering more utility.

Besides the convention toilet auger, plunger, and brush there are some other useful auxiliary tools that can aid in unclogging or cleaning the toilet. For example, many toilet obstructions occur in the mouth of the toilet bowl due to the configuration of the waste outlet duct of the toilet and cannot be easily dislodged by a convention toilet plunger or toilet auger. This results in the needs of a special rod to push obstructions through the outlet duct of the toilet or pull obstructions out from the outlet duct of the toilet to unblock the toilet.

Many toilet obstructions are caused by too much toilet paper or hard stool. These kinds of obstructions are most easily dealt with by dismantling them into smaller pieces to reduce the size before flushing the toilet. This results in the needs for a scraper to cut the obstructions into smaller pieces to prevent the blockage from happen at first place. In addition, this scraper can also remove harder to deal with grime around the toilet area.

Finally, a clogged toilet may be caused by some other foreign materials that accidently falls into the toilet bowl (small toys, towel, cell phone, etc). In order to remove these kinds of obstructions, tongs can be extremely useful in picking up objects from the toilet bowl. This becomes especially useful in public bathrooms, like schools, where maintenance workers are constantly faced with these types of situations.

A user equip with all of these auxiliary tools mentioned above would be far more adept at unclogging a toilet. Furthermore, if these conventional toilet cleaning tools and auxiliary tools can be integrated together as one unit, then the user also saves on space and storage.

A wide variety of combination toilet cleaning tools have been developed for use in unclogging toilets. Known prior inventions includes U.S. Pat. No. 6,804,839 B1 combination toilet brush/plunger apparatus; U.S. Pat. No. 7,430,779 B1 combination toilet brush and plunger; U.S. Pat. No. 8,209,790 B 1, combination bathroom plunging and cleaning tool; U.S. Pat. No. 7,299,519, B1, combination toilet plunger and brush; U.S. Pat. No. 7,308,728, B2, toilet cleaning implement; U.S. Pat. No. 7,752,684, B1, combination-cleaning tool and plunger.

These tools may be suitable for the particular purpose to which they address, but most of these prior art only included a toilet plunger with a toilet brush. None of them include an extra adjustable auger, tongs, and extra drain rod functions; so they would not be suitable for the purpose of the present invention as hereafter described. What's more, some of these devices are generally more expensive than conventional toilet tools and are relatively heavy or cumbersome, making them not practical for general household use.

BRIEF SUMMARY OF THE INVENTION

The general purpose of the present invention is to provide a new multipurpose combination toilet unblocking tool and a combination toilet cleaning tool. In order to support the toilet unblocking function, the combination toilet unblocking tool includes an adjustable auger, a combined tongs, and a detachable rod. The adjustable auger and the detachable rod are integrated into one convenient unit, forming a pair of tongs that can be used. Also, in order to support the toilet cleaning function, the combination toilet cleaning tool includes brush, plunger and scraper accessories, which can be added on in place of the auger. This unit also may be used in conjunction with other attachable bathroom accessories focused on cleaning toilets. Hence, the present invention provides many novel features that are not found or implied by any of the prior art.

According to the present invention, there is provided an adjustable auger, comprising: an elongated sleeve member having a front wall, a back wall and two opposing side walls; wherein the front wall and two side walls are about one inch shorter than the back wall in order to couple the bathroom accessory. A handle is attached to an upper end of the elongated sleeve, wherein the handle is in the shape of a "7" or "D". A central elongated opening divides the front wall into two equal parts and another central opening divides the bottom half of the back wall into two equal parts. Two drain cleaning cables slidably held in the sleeve member, and a slider which is connected with the drain cable and is slidable in the sleeve member in the longitudinal direction. The overall size of the slider is smaller than the bore of the sleeve member, thus the slider can slide in the sleeve member. In order to lock the slider on the opening there are few pairs of slots which cross with the opening of the front wall to hold the slider knobs of the slider and a locking means is provided on the slider for selectively fixing the slider to a desired slots. The locking means is comprised of an interior channel contained inside of the slider, the interior channel is perpendicular to the sliding direction of the slider and communicable with a surface of one side of the slider by a gap; two slider knobs and one compression spring are hold in the interior channel; the compression spring is connected the seating portion of the two slider knob; the compression spring would expand to keep the track gripping portion in the slots after the slider knobs being manipulated to the desired slots. Therefore, the slider may be locked in an extended or retracted position relative to the slots on the sleeve with a locking means. A pair of rings are attached at middle of the back wall of the sleeve. These rings are to be parallel connected with the ring on the easily detachable rod to form a combined tongs. A pair of screws screwed at the lower end of the back wall of the elongated sleeve, these screws can be used as hooks when combined with detached rod as combined tongs. In addition, these screws are to be inserted into the hole of the accessory coupler for coupling the bathroom accessory to the sleeve member.

The present invention also includes a combined tongs assembly. An implementations of the combined tongs comprise of an easily detachable rod member being attached to the rings of the adjustable auger with a hinge pin, thus the adjustable auger and the detachable rod member are pivoted together at their midpoints to form a combined tongs. Therefore, the user can use these combined tongs as conventional tongs to grip and lift the objects that block the toilet, such as too much toilet paper, small toys, towels, etc. An important idea of the invention is to provide combined tongs in the form of an easily detachable rod, constructed in such a manner that the detachable rod member may be used individually, as a drain rod, when desired.

According to an angle of the present invention, there is a detachable rod comprising: an elongate shaft, a handle at one end of the shaft, a ring in the middle of the shaft; a longitudinal hook member at the second end of the shaft, wherein the shaft has two bends located at a position under the ring and each bend is a straight angle. The hook member has a rounded "U" shape and points substantially in the direction of the handle. The hook is also configured insert into the hole of the bathroom accessory. The handle is "7" shaped or "D" shaped also the handle and the hook member are located on the opposite side of the shaft. The section of the shaft that contacts the hook member is on the same plane as the handle and the ring. Typically the handle can be molded or forged to the shaft. However, the entire rod is of a single unitary construction. Also, in order to form a combined tongs, a hinge pin is provide to be used as a pivot axis to connect the adjustable and the rod; the hinge pin is inserted into the ring of the adjustable auger and the ring of the rod.

The present invention further includes a combination toilet cleaning tool. An implementation of a combination toilet cleaning tool is using the combined tongs as a handle and the screws of the combined tongs as accessory coupler to couple detachable bathroom accessory to clean the bathroom. A plurality of different bathroom accessories comprising of at least a toilet plunger and a brush (and optionally a scraper or other bathroom accessory). Each bathroom accessory comprises a first end that is able to be configured onto the cleaning tool. Therefore, each of the conventional toilet brush, plunger and scraper is redesigned as a detachable bathroom accessory.

According to an aspect of the present invention, an implementation of a combination toilet cleaning tool is using the combined tongs as a handle and the screws of the combined tong as an accessory coupler which responsive to an accessory release mechanism on the combined tongs. In particular implementations of the combined tongs, the screws of the combined tongs is configured to inserted into the hole of the bathroom accessory and the accessory coupler of the bathroom accessory is configured to couple the combined tongs. In particular implementations, the bathroom accessory further comprises a coupler member and also including a bathroom accessory being attached to the coupler member. The coupler comprise a cuboid support which has three hole being centrally disposed in and through the cuboid support. These hole are configured to be coupled with the screws of the combined tongs. It is contemplated that each of the bathroom accessory is of a single unitary construction.

As indicated above, none of the prior art includes the combination of the elements of the present invention. It is an object of the present invention to provide many novel features that result in a new combination toilet unblocking tool and toilet cleaning tool which is not provided or implied by any of the prior art. Hence, the main objective of the present invention is to provide a new combination toilet unblocking tool and combination toilet cleaning tool, which also has simpler construction and can be properly used individually as an adjustable auger, a combined tongs, a drain rod or as a plunger, a brush, a scraper.

Another object of the present invention is to provide a new combination toilet unblocking tools that contains an adjustable auger, which may be selectively locked in an extended or retracted position.

An additional object of the present invention is to provide a new combination toilet unblocking tool that contains an detachable rod, which is constructed in such a manner that the detachable rod may be used individually as drain rod, when desired.

Still another object of the present invention is to provide a new combination toilet unblocking tools that contains a combined tongs by providing the adjustable auger and the detachable rod pivoted together at their midpoints to form a combined tongs. Therefore, the combination toilet unblocking tools can be used as a conventional tongs.

Still yet another object is to provide a pair of screws screwed at the lower end of the adjustable auger for coupling different detachable accessories. Accessories may include a brush, a scraper and a plunger.

Even still another object is to provide an accessory coupler for each bathroom accessory; so the bathroom accessories can be selectively coupled to the toilet combined tongs.

A further object is to provide a new combination of toilet unblocking tools along with toilet cleaning tools that are easy and convenient to set up and use.

A still further object is to provide a new combination toilet unblocking tools with a toilet cleaning tools that is economical in cost to manufacture.

Other objects, features and advantages of the present invention will appear as the description proceeds. To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims. It is also to be understood this invention is not limited to the specific components or assembly procedures disclosed herein. The invention is capable of other embodiments and of being practiced and carried out in various ways.

BRIEF DESCRIPTION OF THE DRAWINGS

FIG. 1 is a side elevational view of a conventional toilet auger;

FIGS. 2A and 2B are diagrammatic front and side views of the adjustable auger with the drain cleaning cable extend;

FIG. 3 is an enlarged diagrammatic view illustrating the area indicated by arrow 3 in FIG. 2A;

FIGS. 12A and 12B are front and side view of the adjustable auger with a scrapper accessory attached;

FIG. 13 is an enlarged diagrammatic view illustrating the area indicated by arrow 13 in FIG. 12A;

DETAILED DESCRIPTION OF THE INVENTION

Figure 4:
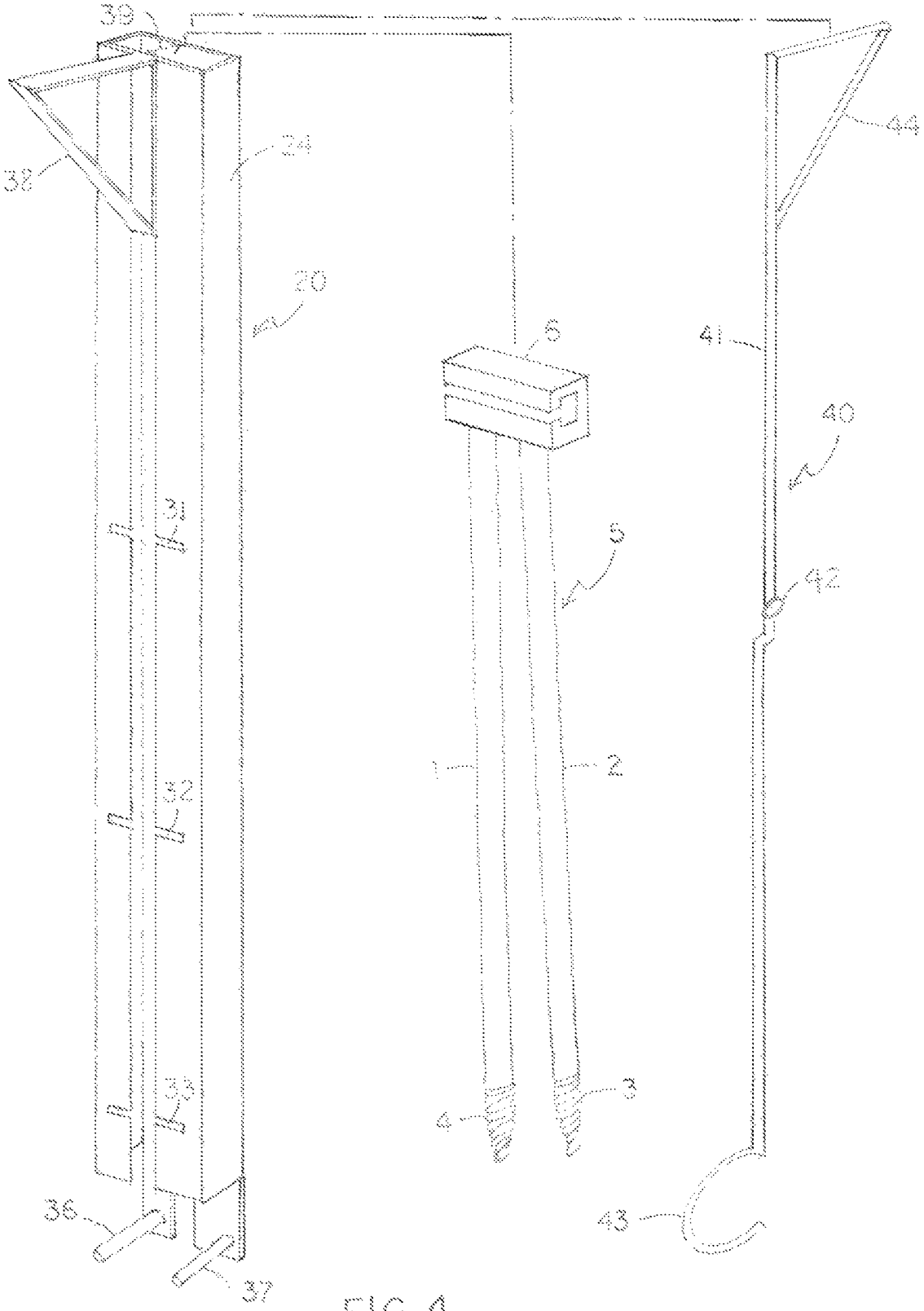
FIG. 4 is an exploded perspective view of a combination toilet unblocking tool and a combination toilet cleaning tool according to an embodiment of the present invention.

The present disclosure is to be considered as an exemplification of the invention, and is not intended to limit the invention to the specific embodiments illustrated by the figures or description below. Although particular implementations are disclosed, such implementations and implementing components may comprise any shape, size, material, quantity, etc. As used in the specification as well as in the appended claims, the term "about" is utilized to modify various numerical values. In this context, the term "about" should be construed to mean any value that is suitable for the invention.

With reference to FIGS. 1 to 16, a description is made below on a combination toilet unblocking tool and a combination toilet cleaning tool according to an embodiment of the present invention. FIGS. 2A and 2B illustrate diagrammatic front and side views respectively of the adjustable auger 10 with the drain cleaning cable 1, 2 extended. As illustrated in FIGS. 2A and 6A, the adjustable auger assembly 10 includes an elongated sleeve member 20, and also including a slider member 6 (refer to FIG. 3) slidably held in the sleeve member 20 and further including two drain cleaning cables 1, 2 being attached to the slider member 6.

FIG. 4 shows an exploded perspective view of the present invention, A sliding cable assembly 5 is slidably inserted into a sleeve member 20 (refer to FIGS. 2A, 2B) to form an adjustable auger. The sliding cable assembly 5 includes a slider 6 and also two drain cleaning cables 1, 2 being securely attached to the slider member 6 (refer to FIGS. 6A, 6B). A separate drain rod member 40, which is to be attached to the sleeve 20 (refer to FIGS. 5A, 10) to form a combined tongs is stood next to the sliding cable assembly 5. Note that in the drawings the lock mechanism to lock the slider 6 to the desired slots is omitted, but will be explained in more detail with reference to FIGS. 6A, 6B, FIGS. 5A and SB illustrate perspective views of the sleeve member 20, As illustrated in FIGS. 5B and 2B a "7" shaped handle 38 attached to an upper end of the elongated sleeve member 20, This handle 38 is used to hold and rotate the sleeve member 20 which is made of the same durable material as the rest of the sleeve member 20, and it can be molded or forged to the sleeve member 20. The handle 38 maybe in another shape of what is typically called a "D" shaped handle but the precise shape of the handle member 38 is not crucial.

Figure 5A:
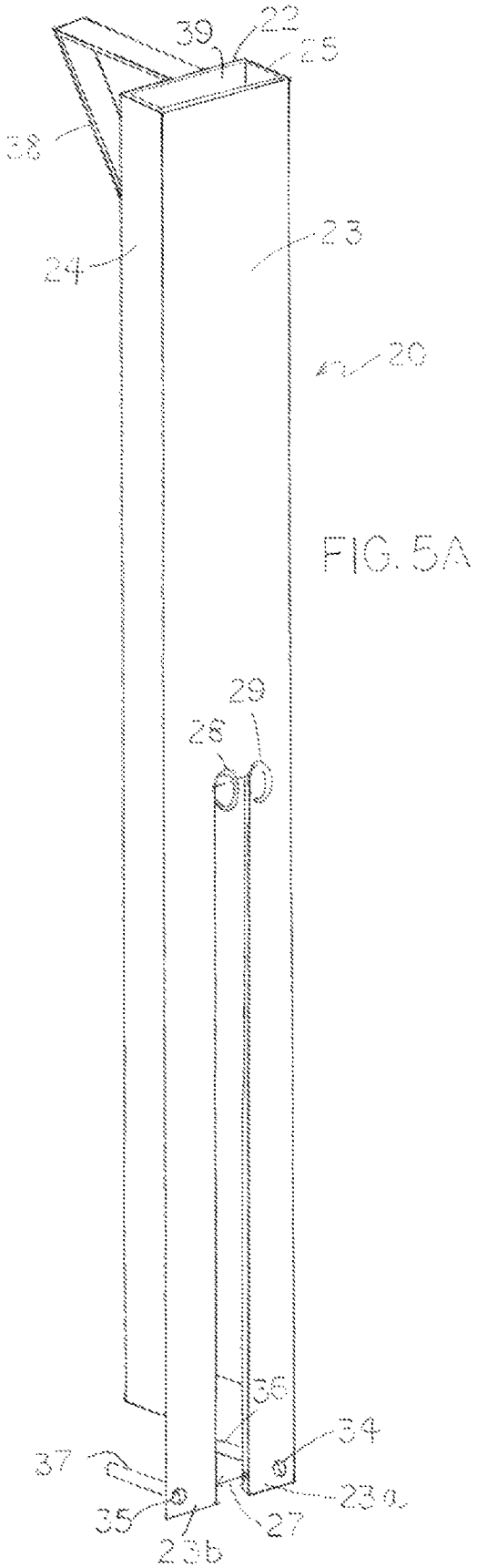
FIGS. 5A and 5B are perspective front and rear views of the sleeve.
Figure 5B:
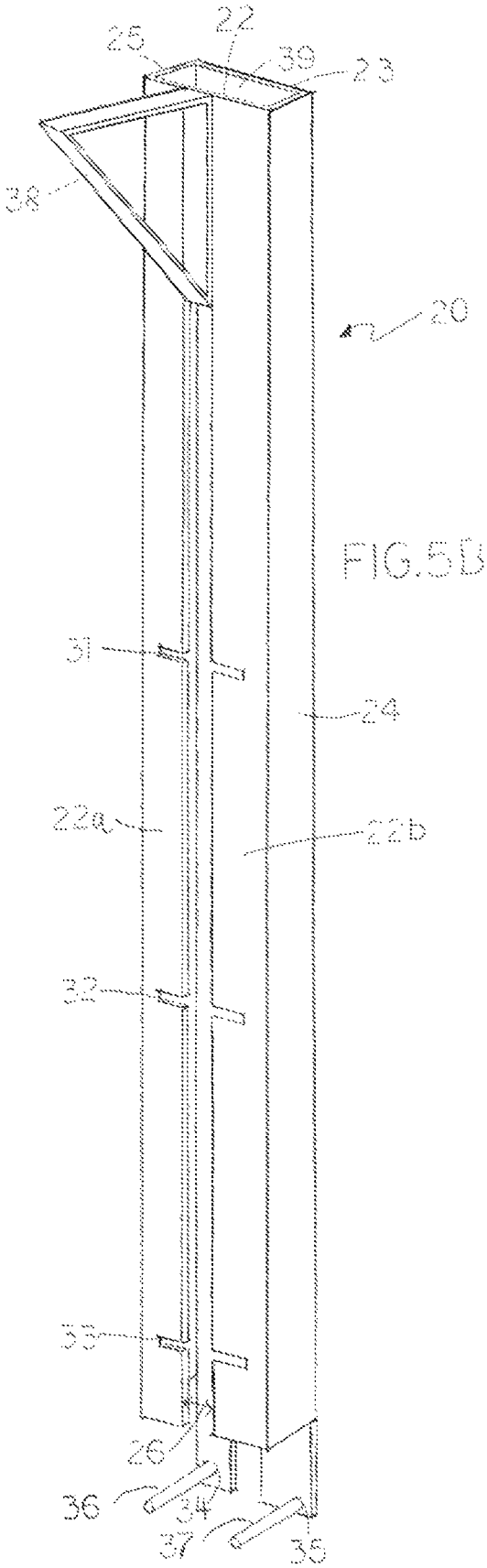
Figure 6A:
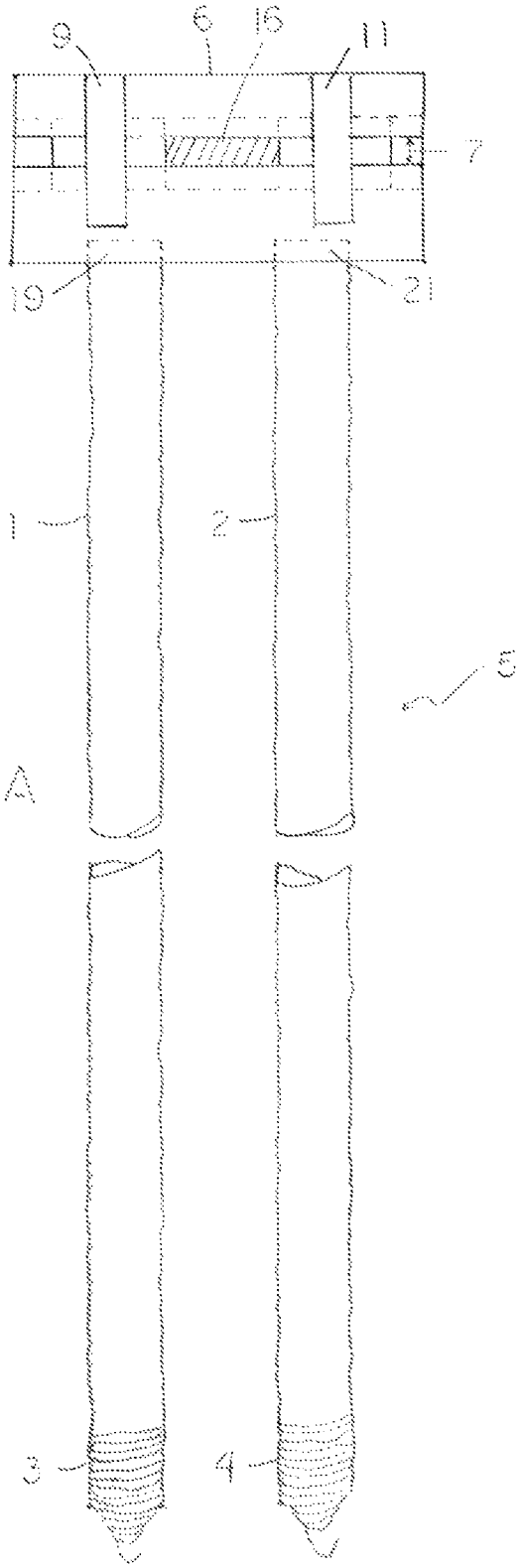
FIGS. 6A and 6B are the front and side elevational view of the slide cable.

As illustrated in FIGS. 5A and 5B the sleeve member 20 is provided with a front wall 22, a back wall 23 and a pair of side walls 24, 25. The sleeve member 20 is made from a durable, rigid material, for example stainless steel or iron. The length of the sleeve member 20 is within the range about forty two inches to forty eight inches. However, the length of the front wall 22 and two side walls 24, 25 are about one inch shorter than back wall 23 in order to couple the bathroom accessory. Operation of how to couple a bathroom accessory is explained in more detail with reference to FIG. 12A. The front wall 22 is provided with a central opening 26, as shown in FIG. 5B. The opening 26 divides the front wall 22 into two equal parts 22*a*, 22*b*. The opening 26 is served as a rail for the slider knob 9, 11 on the slider 6 (refer to FIGS. 2A and 3), so that the slider 6 can slide inside of the sleeve member 20. Also, the opening 26 is substantially wider than the diameter of the rod 40 (refer to FIGS. 4 and 11) so that the rod 40 can also pass through the opening 26 when the rod 40 is attached to the rings 28, 29 of the sleeve member 20 to form a combined tongs. Operation of how to attach the rod 40 to the sleeve member 20 is explained in more detail with reference to FIGS. 10 and 11. Additionally, there are few pairs of slots 31, 32, 33 cross with the opening 26 of the front wall of the sleeve member 20 (refer to FIGS. 2A and, 5B). These slots are configured to hold the slide knob 9, 11 on the slider 6 (refer to FIG. 3). Therefore, these slots are used to provide a lock mechanism for locking the slider knob 9, 11 in a position in practical use.

As illustrated in FIG. 5A on the back wall 23 of the sleeve member 20, there is another opening 27 in the middle which has the same width as opening 26 on the front wall 21.

However, this opening 27 is only opened from the bottom end of the back wall 23 to the middle point of the back wall 23; as a result only the bottom half of the back wall 23 is divided by the opening 27 into two parts 23*a*, 23*b*, and there is no slots on these two parts.

As illustrated in FIG. 5A, there are two rings 28, 29 attached at the middle of the back wall 23*a*, 23*b* of the sleeve member 20 next to the opening 27. The diameter of these rings is about 0.25 inch. These rings are made of the same durable material as the rest of the sleeve member 20, and they can be molded or forged directly to the back wall 23*a*, 23*b*. These rings are configured to parallel connect with the ring 42 on the rod member 40 with the hinge pin 47 to form a combined tongs 30 (refer to FIGS. 10, 11), and they also serve as pivotal support for the rod 40, thus their diameter is same as the ring 42 on the rod 40 but the thickness of the ring is smaller than the diameter of the rod 40. Operation of these rings and the rod is explained in more detail with reference to FIG. 10.

As shown in FIGS. 5A and 5B, there are two holes 34, 35 at the lower end near the outside edge of the back wall 23*a*, 23*b* of the sleeve member 20. Two ordinary screws 36, 37 are screwed in the usual way through the holes. These screws 36, 37 are used to insert into the hole 53, 55 on the accessory coupler 50 (refer to FIG. 14A), so that the bathroom accessory and the sleeve member 20 can be properly coupled (refer to FIGS. 12A, 12B). These screw can also be used to hook objects in the toilet bowl with the hook 43 on the rod 40. Operation of these screws 36, 37 and the hook 43 are explained in more detail with reference to FIG. 10.

Figure 6B:
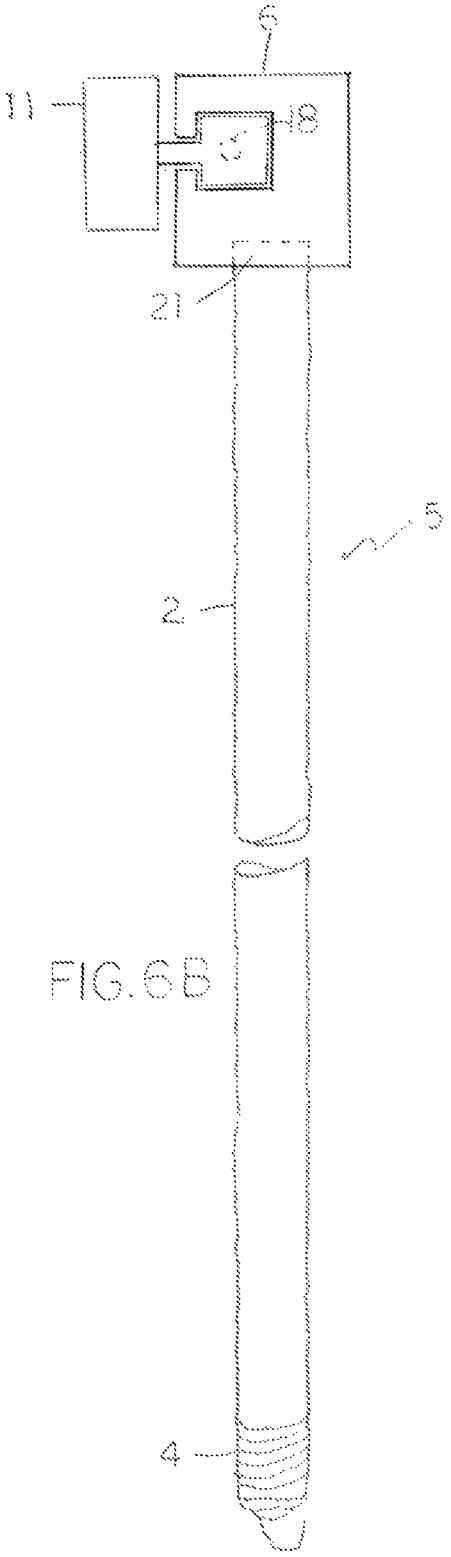

As illustrated in FIGS. 6A, 6B, a sliding cable assembly 5 includes a slider 6, two slide knobs 9, 11, a spring 16 is provided in between slide knobs 9, 11 and also includes two drain cleaning cables 1, 2 being securely attached to the threaded holes 19, 21 of the slider member 6. In order to slide the slider 6 inside the sleeve member 20, the width (W) and length (L) of the slider 6 is smaller than the width (W) and length (L) of the bore 39 of the elongated sleeve member 20 (refer to FIG. 4). As a result, a space is kept between the slider edge and an inner wall of the sleeve member 20. The slider 6 is configured to slide within the sleeve member 20 and is preferably made of metal, or a composite material.

Figure 7A:
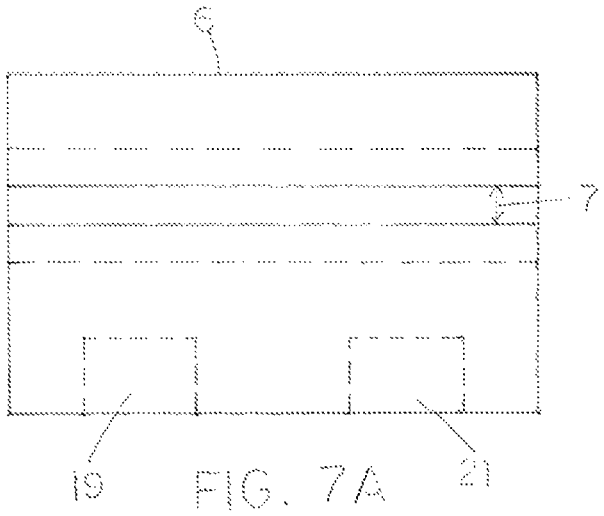
FIGS. 7A, 7B are the front and side view of the slider illustrated in FIG. 6A.
Figure 7B:
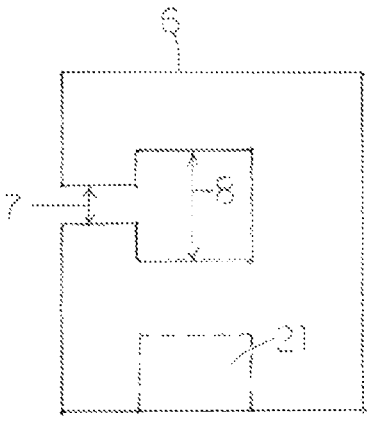
Figure 8C:
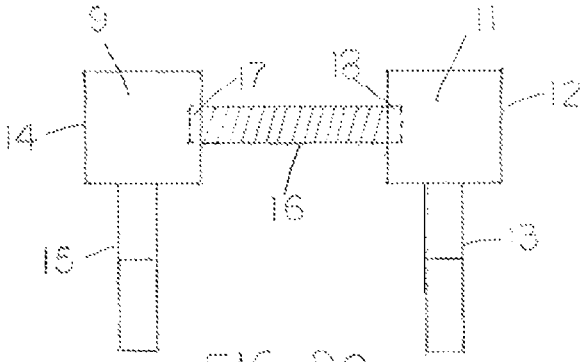
FIG. 8C, is the top view of the slide knob and spring.
Figure 8A:
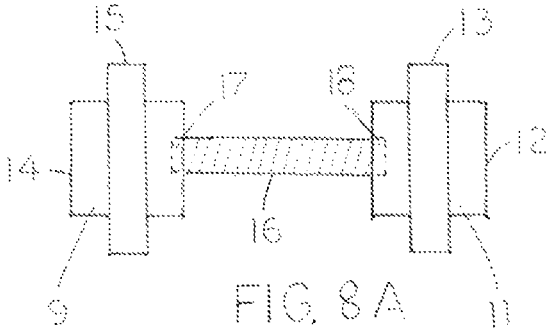
FIG. 8A, is the front view of the slide knob and the spring.
Figure 8B:
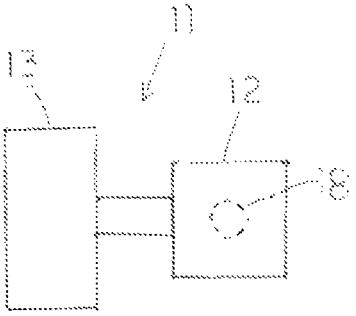
FIG. 8B, is the side view of the slide knob.
Figure 9:
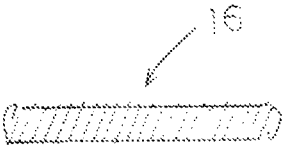
FIG. 9 is a view of the spring illustrated in FIGS. 8A and 8C.

As illustrated in FIGS. 2A, 12A, the slider member 6 may be selectively locked in either an extended or retracted position relative to the slots 31, 32, 33 on the sleeve 20 with a locking means, which is located on middle of one side of the slider 6. FIGS. 7A, 7B are front and side view of the slider member 6. The locking means includes an interior channel 8, two slider knobs 9, 11 and a spring member 16 (refer to FIGS. 6A, 6B). The interior channel 8 is perpendicular to the sliding direction of the slider 6, and is communicable with one side of the surface of the slider 6 by a gap 7. The interior channel 8 and gap 7 is served as a rail for the slider knobs 9, 11. As illustrated in FIGS. 6A, 6B two slider knobs 9, 11, are held in the interior channel 8. FIGS. 8A, 8B, 8C are front, side and top view of the slider knobs 9, 11, and a spring member 16 is provided in between of the two small and shallow hole 17, 18 of these two track seating portion 12, 14 of the slider knob 9, 11. The spring 16 would expand to make the slider knob gripping portion 13, 15 seat in the slots after the slider knobs 9, 11 being manipulated to the desired slots.

As illustrated in FIG. 2A the slider knobs 9, 11 are used to manipulate the slider 6 to desired slots and locked the slider at the slots. FIG. 8B is a side view of the slider knob 11. The slider knob 11 includes an upper gripping portion 13 and a lower track seating portion 12 but the entire slider knob 11 is of a single unitary construction which is preferably made of metal. Also, there is a small and shallow hole 18 located on one side of the middle of the track seating position 12 which is used to fixed one end of the spring 16. In order to move the slider knobs 9, 11 in the interior channel 8, the overall size of the track seating portion 12, 14 is small than the interior channel 8 of the slider 6. As a result, a space is kept between the track seating portion edge and an inner wall of the interior channel 8 of the slider 6. The track seating portion 12, 14 is configured to move within the interior channel 8 of the slider member 6.

As illustrated in FIG. 6A, two conventional drain cleaning cables member 1, 2 with a spiral tip 3, 4 located at the distal end of the drain clean cable member 1, 2 are attached to the threaded hole 19, 21 provided on the slider member 6. Alternatively, the user can use only one drain cleaning cable instead of two, but use two cables can increase the penetration to the blockages. The related position of theses threaded holes 19, 21 on the slider are corresponded to the front wall 22*a*, 22*b* of the sleeve 20 and the distance between these two hole 19, 21 is slightly wider than the opening 26 on the front wall of the sleeve 20 (refer to FIG. 3). The reason for this arrangement is to prevent the drain cleaning cables 1, 2 block the slit opening 26 between the front wall 22*a*, 22*b* and the slit opening 27 between the back wall 23*a*, 23*b* on the sleeve member 20, when the user using this sleeve member 20 with rod member 40 as a combined tongs. Operation of how to use sleeve member 20 with rod member 40 as combined tongs is explained in more detail with reference to FIGS. 10, 11. The drain clean cable 1, 2 as in conventional is an elongate flexible member made of tightly wound drain cleaning cable wire. The drain clean cable 1, 2 has a length that is about three feet (1 m).

In operation, a user can manipulate the slider knob 9, 11 to cause the slider 6 to slide, so that the drain cleaning cables 1, 2 are protruded from or retracted into the sleeve member 20 (refer to FIG. 2A). Being guided in the walls of the sleeve member 20 the drain cleaning cable 1, 2 and the slider 6 slide in the longitudinal direction of the sleeve member 20. After the slider 6 is reached to the desired slots, and the drain cleaning cable 1, 2 is inserted into the drain of the toilet then the user can release the slider knob 9, 11 fitting the gripping portions 13, 15 into the slots on the front wall 22*a*, 22*b*. Since the slider 6 operatively engages the sleeve member 20 and the drain cleaning cables 1, 2 operatively engages the slider 6 such that rotation of the sleeve member 20 about the longitudinal axis causes the drain cleaning cables 1, 2 to rotate generally about the longitudinal axis. In use, the user grips the handle 38 with both hand to turn the sleeve member 20, then the elongated drain cleaning cables 1, 2, and the spiral tips 3, 4 will rotate to open the clogged drain in the toilet bowl.

Figure 10:
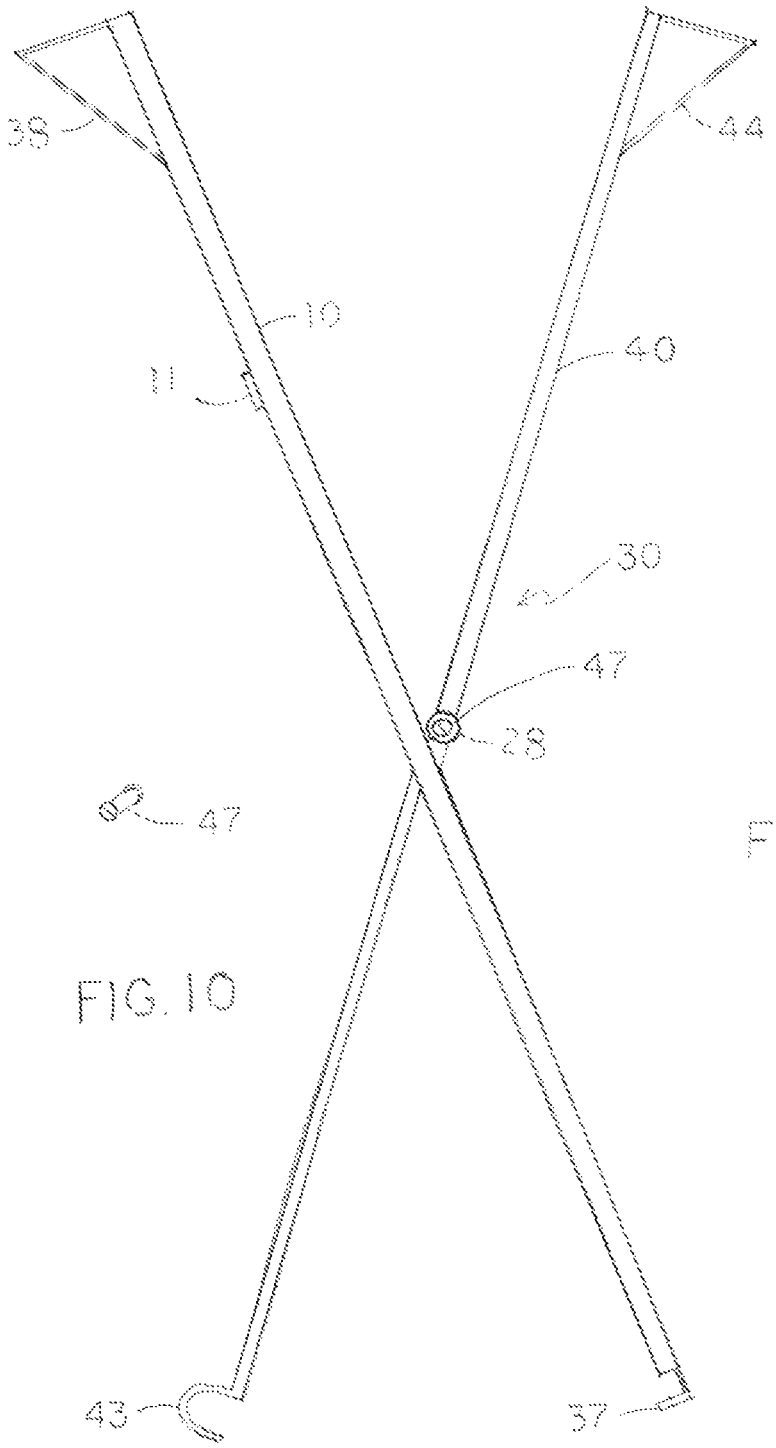
FIG. 10 is a side elevational view of assembled togs embodying the invention.
Figure 11:
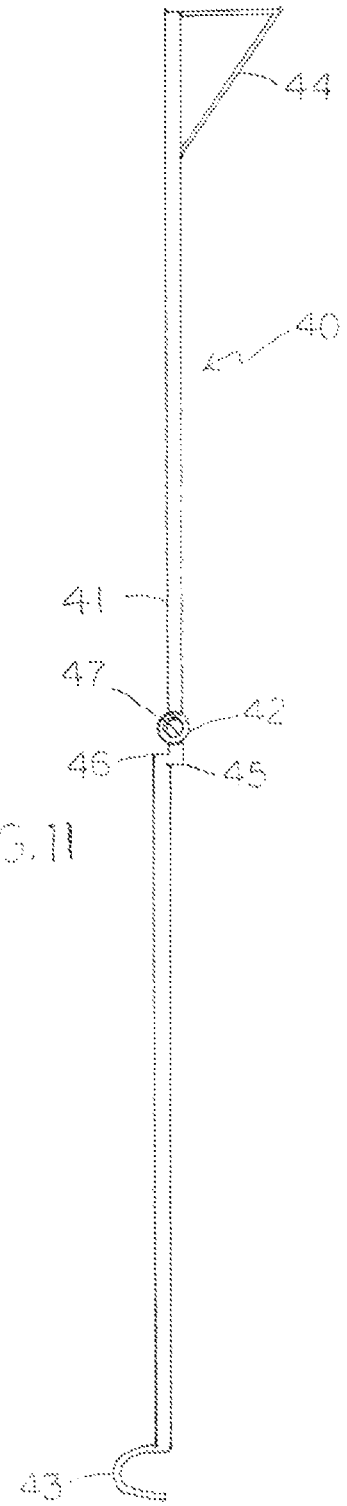
FIG. 11 is a side elevational view of a rod forming one side of the tongs.

The present invention also includes a combined tongs assembly. FIG. 10 illustrates a diagrammatic side elevation view of the combined tongs 30. As illustrated in FIG. 10 A combined tongs assembly 30 includes the adjustable auger 10 and also including a detachable rod 40 (refer to FIG. 11) being attached to the rings 28, 29 (refer to FIG. 5A) of the adjustable auger 10 to form a combined tongs. An important object of the invention is to provide combined tongs 30 in the form of easily-detachable rod, constructed in such a manner that the detachable rod member 40 may be used individually as drain rod, when desired. FIG. 11 illustrates a diagrammatic side elevation view of the detachable rod 40 of the present invention. The detachable rod 40 comprises a shaft 41, a ring 42 in the middle of the shaft 41, a "U" shaped hook 43 extending longitudinally from one end of the shaft 41, and a handle 44 at the opposite end of the shaft 41. The shaft 41 is made of stainless steel or iron and the length of the shaft 41 is same as the length of the adjustable auger member 10. The diameter of the shaft 41 is slightly smaller than the opening 26 on the front wall 22, and opening 27 on the back wall 23 of the adjustable auger 10, so that the shaft 41 can pass through the opening 26, 27 when open the combined tongs. (refer to FIGS. 5A, 5B)

As illustrated in FIG. 11, the detachable rod member 40 has a "7" shaped handle 44 attached to an upper end of the shaft member 41. The handle 44 of the shaft 41 is made of the same durable material as the shaft 41, and is molded or forged directly onto the shaft 41. The handle can be any shape or size comfortable for holding by a user and the precise shape of the handle member 44 is not crucial. A ring 42 is in the middle of the shaft 41 which is used to parallel connect with the rings 28, 29 on the adjustable auger 10 to form a combined tongs (refer to FIG. 5A); therefore the size and diameter of the ring 42 is same as the rings 28, 29 on the adjustable auger 10. The shift 41 has two bends beneath the ring 42. The first bend 45 is bent at an angle about 90° opposite the handle 44 direction; the second bend 46 is immediately bent downward next to the first bend 45 and opposite the upper end of the shift 41, which is bent at another 90°. The second bend makes the bottom half of the shaft 41 standing between in the slit opening 27 of the back walls 23*a*, 23*b* of the adjustable auger 10 when the combined tongs is closed (refer to FIG. 12B). What's more, having the bottom half of the shaft 41 bent within these specified angles allows the "U" shaped hook member 43 to be inserted into the hole 54 on the accessory coupler 50 to help fixate the accessory coupler 51 when couple a bathroom accessory. Operation of this "U" shaped hook is explained in more detail with reference to FIGS. 12A, 12B.

As illustrated in FIG. 11 at the lower end of the shaft 41 opposite the upper end and opposite the handle 44 direction, has a "U" shaped hook member 43 extending longitudinal from the shaft 41. As illustrated in FIG. 11 the handle 44, the ring 42 and the "U" shaped hook member 43 are located on the same plane and the end of the hook member 43 points substantially in the direction of the handle. It is contemplated that the entire rod 40 is of a single unitary construction. This "U" shaped hook 43 is configured to insert into the hole 54 on the accessory coupler 50 which also allow for pulling or push the clog in the toilet bowl (refer to FIGS. 12A, 14A). When parallel connecting the ring 42 of the shaft 41 to the ring 28, 29 on the adjustable auger 10 with a hinge pin 47 to provide a pivot axis, the adjustable auger 10 and the rod 40 are connected and crossed to form a combined tongs 40.

In operation, the user can grip the handle 38 of the adjustable auger 10 in one hand and grip the handle 44 of the rod 40 in another hand to open this combined tongs 30 as conventional tongs. Therefore, the user can use this combined tongs 30 to pick up the objects that block the drain, such as too much toilet paper, or other objects that falls into the toilet bowl, such as small toy.

In addition, as described above, the present invention also allows the detachable rod 40 to be used individually as a simple drain rod. As shown in FIG. 10 when detaching the hinge pin 47 from these rings 28, 29 of the adjustable auger 10, then the adjustable auger 10 and the rod member 40 (refer to FIG. 11) are separated.

In use, when using this detachable rod 40 as simple drain rod, the user can grip the handle 44 of the rod in one hand then push clogged materials in the toilet bowl into the drain with the hook 43, or pulling the clogged materials from the drain with the hook 43 to unclog a toilet.

Finally, as described above, another particular implementation of the present invention allows the combined tongs 30 to couple a bathroom accessory to clean the toilet area. FIGS. 12A and 12B are diagrammatic front and side elevation views of the closed combined tongs 30 (refer to FIG. 10) with a scraping accessory 51 attached. As illustrated in FIG. 4 the screws member 36, 37 on the back walls 23*a*, 23*b* of the sleeve member 20 and the "U" hook member 43 on the detachable rod 40 can be used to couple the bathroom accessory. As shown in FIGS. 14A, 14B, 15, 16 the bathroom accessories may include a plunger 57, a brush 56, and a scraper 51 (the use of scraper will be describe below). However, in order to use these additional bathroom accessories to clean the toilet area, each of the bathroom accessory must comprises an accessory coupler 50 configured to be coupled by the screws member 36, 37 and the "U" hook member 43. The accessory coupler 50 assists in coupling the bathroom accessory 51 to the combined tongs 30.

Figure 14A:
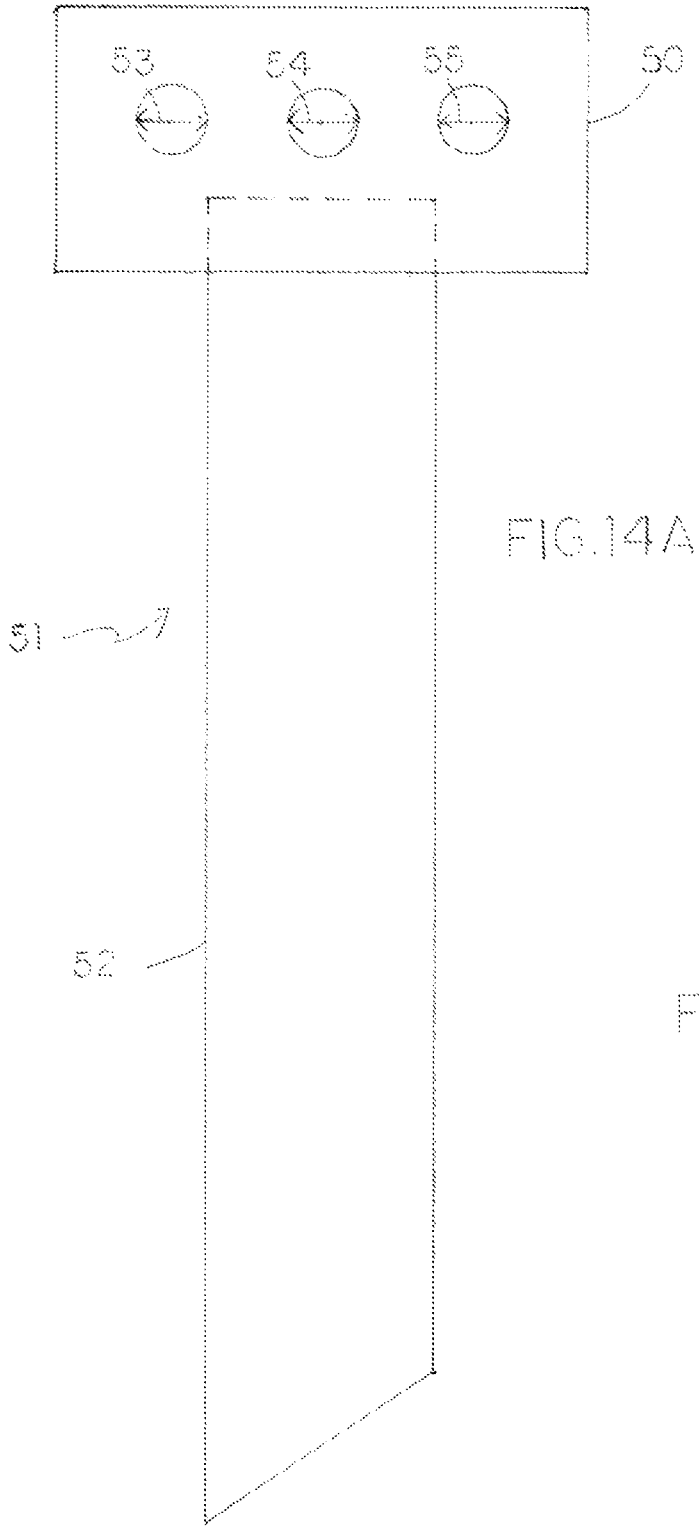
FIGS. 14A and 14B are front and side view of the scrapper accessory.
Figure 14B:
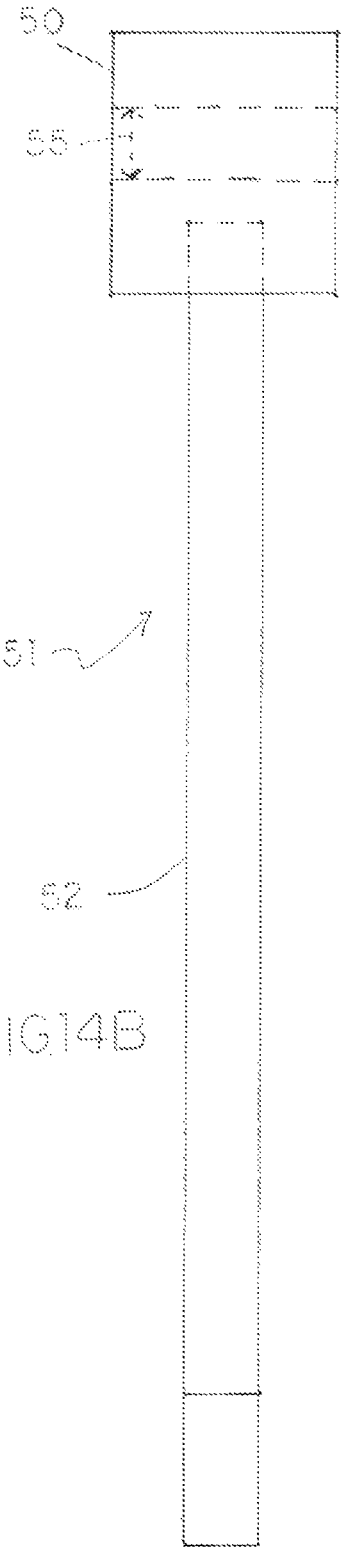

FIGS. 14A, 14B illustrate one particular implementation of a scraping accessory 51. The scraping accessory 51 includes two parts including an accessory coupler 50, and also including a scraper member 52 being attached to the accessory coupler 50. The accessory coupler 50 may be made of rubber, plastic, composite material, or other material suitable for use with the scraper 52, as known in the relevant art. The scraper 52, like conventional scraper, may be made of a piece metal or may be in the shape of rectangular blade. The precise shape of the scraper 52 is not crucial. The function of the scraper 52 is to cut large piece toilet paper or hard stool into small pieces. This is a very useful function that will save a lot of time and effort if used appropriately. Since the most common waste that block the toilet are caused by large piece toilet paper or hard stool; if the user can cut them up into small pieces then it would be easy to flush these small obstruction in to the toilet. In addition, this scraper 52 can scrape other hard-to-remove materials in the toilet bowl area.

Figure 15:
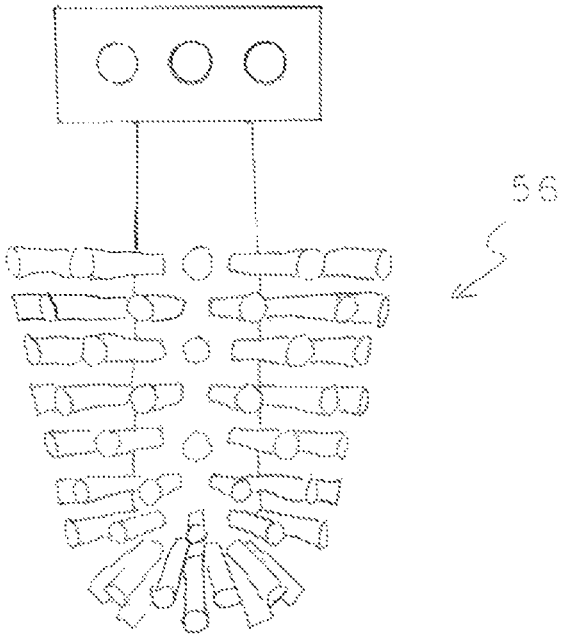
FIG. 15 is a view of a brush accessory.
Figure 16:
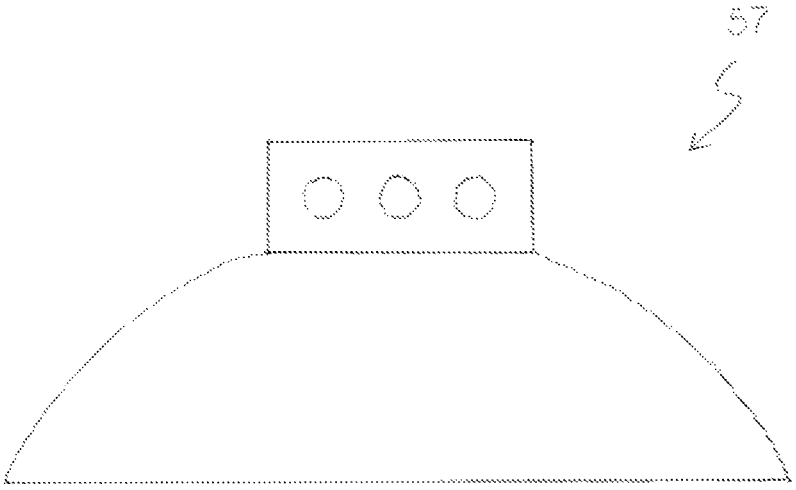
FIG. 16 is a views of a plunger accessory.

As illustrated in FIGS. 14A, 14B, a first end of the scraping accessory 51 comprises an accessory coupler 50 which is configured to attach a scraper member 52 and also can be coupled to the combined tongs 30. The accessory coupler 50 includes a cuboid support including three holes 53, 54, and 55 being centrally disposed in and through the cuboid support. The holes 53, 54, 55 are configured to be coupled with the screws 36, 37 of the sleeve member of 20 and the U-hook member 43 of the detachable rod 40 of the combined tongs 30. (refer to FIGS. 12A, 12B). As shown in FIGS. 14A, 14B a blade (scraper) 52 is attached to the accessory coupler 50; the scraping accessory 51 may be molded or formed by methods known in the art for molding or forming the material used to make the scraping accessory. It is contemplated that the entire bathroom accessory is of a single unitary construction. FIG. 15 is a view of a plunger accessory and FIG. 16 is a views of a brush accessory. The shape of the plunger and brush is not crucial. (there are conential plunger).

In operation, to couple the combined tongs 30 to the scraping accessory 51, the user can grips the handle 38 of the adjustable auger 10 in one hand and grips the detachable rod handle 44 in another hand to open the combined tongs 30 and placed the combined tongs above the scraping accessory 51 then close the combined tongs 30; so that the screws 36, 37 of the adjustable auger 10 are inserted into hole 53, 55 of the scraping coupling 51, and the "U" hook member 43 of the detachable rod 40 is inserted in to hole 54 of the scraping coupling 51. To decouple the scraping accessory 51, the user simply put the scraping accessory 51 in a cell of a storage box (omitted) against the wall of the storage box then open the combined tongs; so the scraping accessory 51 will fall into the storage box.

In use, a user in need of any of the accessories available from the storage box may simply select the accessory from the storage box. Note that in the drawings and the detail specification of the storage box for the bathroom accessory is omitted, because the storage box is not council. However, in an actual product, a simple open box divides into several cells and configured to store each accessory and the combined tongs member will be provided.

While certain novel features of this invention have been shown and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A combination toilet unblocking and cleaning tool, comprising:

an adjustable auger assembly including:

an elongated sleeve member having a front wall, a back wall and two opposing side walls, wherein the front wall and the two side walls are about one inch shorter than said back wall;

a handle attached to an upper end of said elongated sleeve member, wherein the handle has a "7" shape or "D" shape;

a central elongated opening dividing the front wall of the sleeve member into two equal parts, and another central opening dividing a bottom half of the back wall of the sleeve member into two equal parts;

two drain cleaning cables slidably held in the sleeve member, and a slider connected with the drain cleaning cables and being slidable in the sleeve member in the longitudinal direction, wherein the drain cleaning cables are manipulated by the slider to protrude from and retract into the sleeve member, said slider is smaller than a bore of the sleeve member, said slider can slide in the sleeve member;

a plurality of pairs of slots crossing the central opening of the front wall of the sleeve member, wherein said slots are used to hold two slider knobs of the slider, said slider knobs each includes an upper gripping portion and a lower track seating portion;

a locking means provided on the slider for selectively fixing the slider to a desired pair of slots, and two threaded holes provided on one side of the slider, wherein said two drain cleaning cables are attached to the threaded holes of the slider;

a pair of rings attached to a middle of the back wall of the sleeve member; and a pair of screws screwed at a lower end of the back wall of the elongated sleeve member, wherein said pair of screws can be used as hooks for the sleeve member;

a detachable rod including:

an elongated shaft, a handle disposed at a first end of the shaft, and a ring disposed at a middle of the shaft; and a longitudinal hook member disposed at a second end of the shaft, wherein the shaft has two bends located under the ring and each bend is a 90 degree angle, wherein the hook member has a rounded "U" shape and points substantially in the direction of the handle;

wherein the handle has a "7" shape or a "D" shape, and the handle and the hook member are located on opposite sides of the shaft;

wherein the hook member is on the same plane as the handle and the ring; and wherein the detachable rod is removably attached to the rings of said adjustable auger assembly with a hinge pin to form a combined tongs; and a plurality of bathroom accessories comprising at least a toilet plunger, a brush and a scraper, wherein each bathroom accessory is configured to be removably coupled to the screws of the combined tongs, wherein the bathroom accessory and the combined tongs are combined to form a combination toilet cleaning tool assembly used to clean the bathroom, the combined tongs is used as a handle and the screws of the combined tongs are coupled to an accessory coupler of the bathroom accessory to couple the detachable bathroom accessory, wherein the screws of the combined tongs is responsive to an accessory release mechanism on the combined tongs, and said screws of the combined tongs is configured to be inserted into holes of the bathroom accessory.

2. The combination toilet unblocking and cleaning tool of claim 1, wherein said locking means comprises: an interior channel disposed inside the slider, said interior channel is perpendicular to the sliding direction of the slider and is communicable with a surface of one side of the slider by a gap.

3. The combination toilet unblocking and cleaning tool of claim 2, wherein two slider knobs and one compression spring are held in the interior channel; said compression spring is connected with the seating portion of the two slider knobs; said compression spring expands to keep the upper gripping portions in the slots after the slider knobs are manipulated to the desired slots.

4. The combination toilet unblocking and cleaning tool of claim 1, wherein the detachable rod is of a single unitary construction.

5. The combination toilet unblocking and cleaning tool of claim 1, wherein the hinge pin is inserted into the rings of said adjustable auger assembly and the ring of said detachable rod to form the combined tongs, and said hinge pin is used as pivot axis to connect the adjustable auger assembly and the detachable rod.

6. The combination toilet unblocking and cleaning tool of claim 1, wherein the detachable rod may be used individually as a drain rod when desired.

7. The combination toilet unblocking and cleaning tool of claim 1, wherein the accessory coupler comprises a cuboid support, three holes centrally disposed in and through the cuboid support, and said holes are configured to be coupled with the screws of the combined tongs.

8. The combination toilet unblocking and cleaning tool of claim 1, wherein each of the bathroom accessories is of a single unitary construction.

9. The combination toilet unblocking and cleaning tool of claim 1, wherein each of said drain cleaning cable is an elongated flexible cable made of tightly wound drain cleaning cable wire with a spiral tip located at the distal end of the drain cleaning cable.

10. The combination toilet unblocking and cleaning tool of claim 1, wherein the rings of the adjustable auger assembly are parallelly connected with the ring on the detachable rod to form the combined tongs.

11. The combination toilet unblocking and cleaning tool of claim 1, wherein said screws are inserted into the holes of the accessory coupler for coupling the bathroom accessory to the sleeve member.

12. The combination toilet unblocking and cleaning tool of claim 1, wherein the "U" shaped hook member is also configured to insert into the hole of the bathroom accessory.

* * * * *